US005771591A

United States Patent [19]

Armbruster et al.

[11] Patent Number: 5,771,591

[45] Date of Patent: Jun. 30, 1998

[54] DISPOSABLE RESILIENT RAZOR

[76] Inventors: Joseph M. Armbruster; Sue B. Armbruster, both of 2700 NE. 47 St., Lighthouse Point, Fla. 33064

[21] Appl. No.: 535,578

[22] Filed: Sep. 28, 1995

[51] Int. Cl.[6] ..... B26B 21/56

[52] U.S. Cl. ..... 30/527; 30/340

[58] Field of Search ..... 30/85–89, 80, 30/527, 528, 530, 531, 532, 340

[56] References Cited

U.S. PATENT DOCUMENTS

| | | | |
|---|---|---|---|
| 3,823,471 | 7/1974 | Stone | 30/85 |
| 5,341,571 | 8/1994 | Prochaska | 30/50 |

FOREIGN PATENT DOCUMENTS

| | | | |
|---|---|---|---|
| 2030909 | 2/1980 | United Kingdom | 30/89 |

*Primary Examiner*—Douglas D. Watts
*Attorney, Agent, or Firm*—Jacobson, Price, Holman & Stern, PLLC

[57] ABSTRACT

A disposable resilient razor in which the razor includes a handle and a razor head interconnected by a resilient, flexible, reduced diameter area of plastic material of one piece construction with the handle and head to enable universal or global flexible, resilient movement of the razor head in relation to the handle. The flexible, resilient, reduced diameter area connecting the handle to the razor head retains the handle and razor head in normal position until a force is applied to the handle when the razor head is engaged with a skin surface to be shaved. This enables a razor blade having a cutting edge mounted on the razor head to be oriented in parallel, substantially flush relation to the skin surface. The razor head has a large flat surface area before and after the blade cutting edge which positions the cutting edge in parallel, flush relation to the skin surface for preventing the cutting edge from digging into the skin surface thereby eliminating nicks and cuts and positioning the cutting edge for cutting hair shafts in perpendicular relation to the axis of hair shafts and parallel to and adjacent the skin surface. The handle of the razor has concave longitudinal side surfaces and convex edge surfaces which enables the razor to be held lightly, in a manner similar to a violin bow, thereby avoiding the use of a pinching grip which is necessary to hold a straight shaft handle of a conventional razor.

11 Claims, 6 Drawing Sheets

DISPOSABLE RESILIENT RAZOR

BACKGROUND OF THE INVENTION

The present invention generally relates to a disposable razor and more specifically to a disposable resilient razor in which the razor includes a handle and a razor head interconnected by a resilient, flexible, reduced diameter area of plastic material of one piece construction with the handle and head to enable universal or global flexible, resilient movement of the razor head in relation to the handle. The flexible, resilient, reduced diameter area connecting the handle to the razor head retains the handle and razor head in normal position until a force is applied to the handle when the razor head is engaged with a skin surface to be shaved. This enables the razor blade to be retained in parallel relation to the skin surface by inhibiting the blade from digging into the skin surface at an angle thereto that would cause nicks and cuts.

The razor head has a large flat surface area or pad before and after the blade edge which aligns the blade with the skin surface. This also positions the cutting edge of the blade at the optimum angle to cut the hair shaft at a 90° angle to the longitudinal axis of the hair shaft and in parallel relation to the skin surface. This enables the cutting edge of the blade to be disposed substantially flush with the skin surface thereby eliminating stubble. Because the hair shaft is stiffer or more rigid at the skin surface, the closer the cutting edge of the blade is to the skin surface and the closer to the skin surface that the hair shaft is cut, the straighter the cut transversely of the hair shaft will be. When the hair shaft is cut any distance from the skin surface where the hair shaft is more flexible increases the probability that the hair shaft will be cut on a bias or on a diagonal rather than perpendicular to the hair shaft which will leave short stubble. Also, by cutting into the hair shaft on a bias and not cutting cleanly through the hair shaft at 90° relation causes the blade cutting edge to grab the hair shaft and attempt to "pull the hair shaft out by the root" which causes pain and requires multiple shaving strokes in an effort to obtain a smooth shave. Even if a person using the razor of this invention exerts too much pressure on the handle, the combined result of the flat pad and the reduced diameter area between the handle and razor head also limits or prohibits the cutting edge from digging into the skin surface and too much blade pressure being exerted on the skin resulting in the elimination of "nicks and cuts" and "razor burn or skin abrasion". The reduced diameter area connecting the razor handle to the razor head is somewhat elongated and is in the form of a shaft area of generally circular cross-sectional configuration and having a substantially constant diameter over a predetermined length to enable the flexible, resilient movement of the razor head in relation to the handle in order to follow the skin surface.

The large rub or skin engaging surface on the razor head ensures accurate blade-to-skin alignment even if the handle is not in alignment with the blade and head when the shaving stroke is started. When the shaving stroke is started, the razor head and blade will quickly move with respect to the razor handle and quickly assume proper relationship to the skin surface by the pressure exerted on the handle. The handle of the razor having concave longitudinal side surfaces and convex edge surfaces enables the razor to be held lightly, in a manner similar to a violin bow, thereby avoiding the use of a pinching grip which is necessary to hold a straight shaft handle of a conventional razor. This structure of the handle permits a feel of the blade alignment with the handle whereas a conventional round shaft or square shaft handle gives no indication of the handle/blade position or relationship. This also eliminates the necessity of putting grooves, holes, rough texture or any other nonslip properties on the handle since the shape of the handle precludes slippage of the gripping fingers and thumb on the handle.

The razor head includes exhaust ports in the back side to enable cut hair and shaving lubricant to be exhausted through these ports and trapped on the back side of the razor head. The razor head includes pins molded into the plastic outer blade retainer with the pins passing through the steel blade and protruding through the blade support member with the pins then being heat staked to secure the razor head assembly in assembled relation. The razor, except for the steel blade, is constructed of polypropylene plastic capable of effective use in various temperature conditions with the "memory" characteristics of the plastic material returning the flexed or resiliently pivoted or rotated relationship of the head back to a normal relationship between the razor head and handle thereby assuring that each time the razor is lifted off the skin surface, the razor head and handle will return to a normal desired relation. This structure enables an effective shaving operation to be accomplished by maintaining proper alignment and association of the razor blade cutting edge with the skin surface being shaved with the flexible, resilient shaft between the handle and razor head enabling the razor head and razor blade to be moved to correct relationship with the skin surface and whisker hair shafts when pressure is exerted on the razor handle.

DESCRIPTION OF THE PRIOR ART

Many types of disposable razors have been marketed which include a razor handle and razor head constructed of plastic material with a portion of the razor head being integral and rigid with the handle, sometimes in offset angular relation. The razor head receives a razor blade and a plastic retainer secures the razor blade to that portion of the razor head that is integral with the handle. This type of disposable razor includes a rigid relationship between the razor and razor head so that the relationship of the razor blade edge to the skin surface being shaved is determined solely by the position of the handle which is rigid with respect to the razor head.

Another type of disposable razor includes a similar razor handle and head which is offset and angulated in relation to the longitudinal axis of the handle with there being a pivotal connection between the razor head and handle. This enables the razor head to freely pivot about only a single axis that is parallel to the longitudinal axis of the razor blade or blades and razor head. This structure enables free and unrestricted pivotal movement of the razor head in only one direction and only in one plane within prescribed limits about an axis transverse to the longitudinal axis of the handle and about an axis generally parallel to the skin surface.

Presently available disposable razors do not include any structure which enables flexible, resilient movement of the razor head in any direction in the XYZ planes of movement in relation to the handle. Contrary to the capability of movement of razor heads on existing disposable razors, the present invention introduces universal or global movement capability of the razor head and razor blade to enable immediate proper orientation of the razor blade cutting edge with the skin surface when force is exerted on the handle to overcome the resiliency of the reduced diameter shaft of the plastic material interconnecting the plastic handle and razor head with the razor head when the razor head engages the skin surface. The razor head includes a large flat surface area or pad which engages the skin surface and causes the razor head and razor blade edge to properly relate to the skin surface. The razor head always returns to normal position with respect to the handle when the razor is disengaged from the skin surface being shaved.

SUMMARY OF THE INVENTION

An object of the present invention is to provide a disposable resilient razor having a flexible, resilient, reduced diameter plastic connecting area between a plastic razor handle and a plastic razor head having a razor blade mounted therein to enable flexible, resilient movement of the razor head by resilient bending or flexing of the flexible, resilient connection.

Another object of the invention is to provide a resilient disposable razor in accordance with the preceding object in which the razor handle, reduced flexible connecting area and a portion of the razor head are of one piece plastic construction with the razor head including a razor blade support, a razor blade and razor blade retainer having a substantially large, flat skin engaging or skin rubbing surface area before and after the cutting edge of the blade to enable the blade to be accurately aligned with the skin surface when pressure is exerted on the handle by a person using the razor.

A further object of the invention is to provide a disposable resilient razor in accordance with the preceding objects in which movement of the razor head in any direction of movement is accomplished by overcoming the inherent resiliency of the connecting area between the razor handle and razor head to position the cutting edge of the razor blade substantially flush against the skin surface to cut hair shafts in perpendicular relation to the relatively stiff area of the hair shaft adjacent the skin surface.

Still another object of the invention is to provide a disposable resilient razor in accordance with the preceding objects in which the handle is provided with concave, elongated side surfaces and convex top and bottom edges and a concavely curved end remote from the razor head to facilitate secure but light gripping engagement of the handle with the thumb and fingers of a user thereby enabling more effective control of the force exerted on the razor handle when shaving which combined with the flexible, resilient connection between the razor handle and razor head enables the large flat rubbing area of the razor head to automatically orient the razor blade edge in proper relation to the skin surface being shaved when pressure is exerted on the razor blade handle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
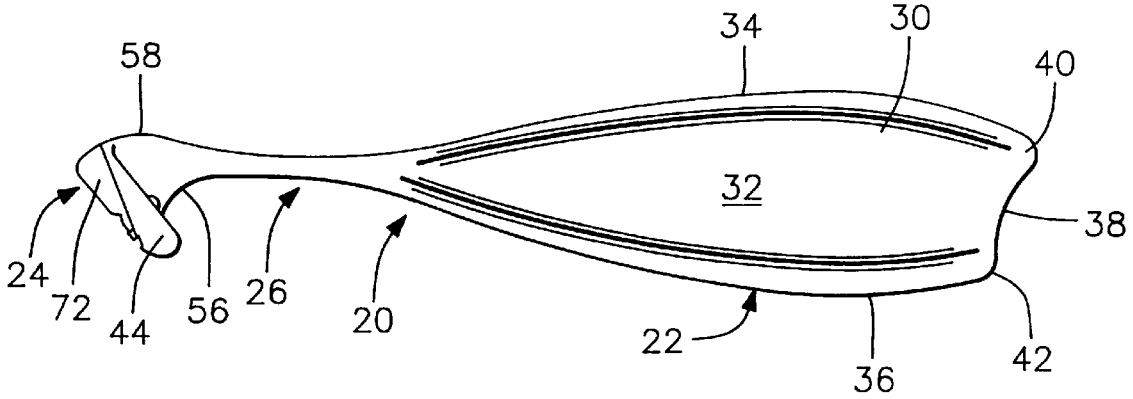
FIG. 1 is a side elevational view of the disposable resilient razor of the present invention.

Referring now specifically to the drawings, the disposable resilient razor of the present invention is generally designated by reference numeral 20 and includes a razor handle 22, a razor head 24 and a flexible, resilient, reduced diameter connecting area 26 interconnecting the razor head 24 and the razor handle 22. All of the components of the razor 20 are of plastic material, such as polypropylene or other similar plastic material having resilient and memory characteristics, except for a steel razor blade generally designed by reference numeral 28 and illustrated in FIG. 8.

The razor blade handle includes an elongated member 30 having concavely curved side surfaces 32 which extend longitudinally substantially throughout the length of the handle 22 with the surface area 32 also being concavely curved transversely between top and bottom edges of the handle. The top and bottom edges of the handle are designated by reference numerals 34 and 36 and are convexly curved longitudinally as illustrated in FIG. 1. The end of the handle 22 remote from the razor head is provided with a concavely curved edge 38 which has a rounded corner 40 merging with the top edge 34 of the handle and a rounded corner 42 merging with the lower edge 36 of the razor handle with the lower rounded edge 42 being spaced inwardly toward the razor head 24 as compared to the rounded upper corner edge 40.

Figure 8:
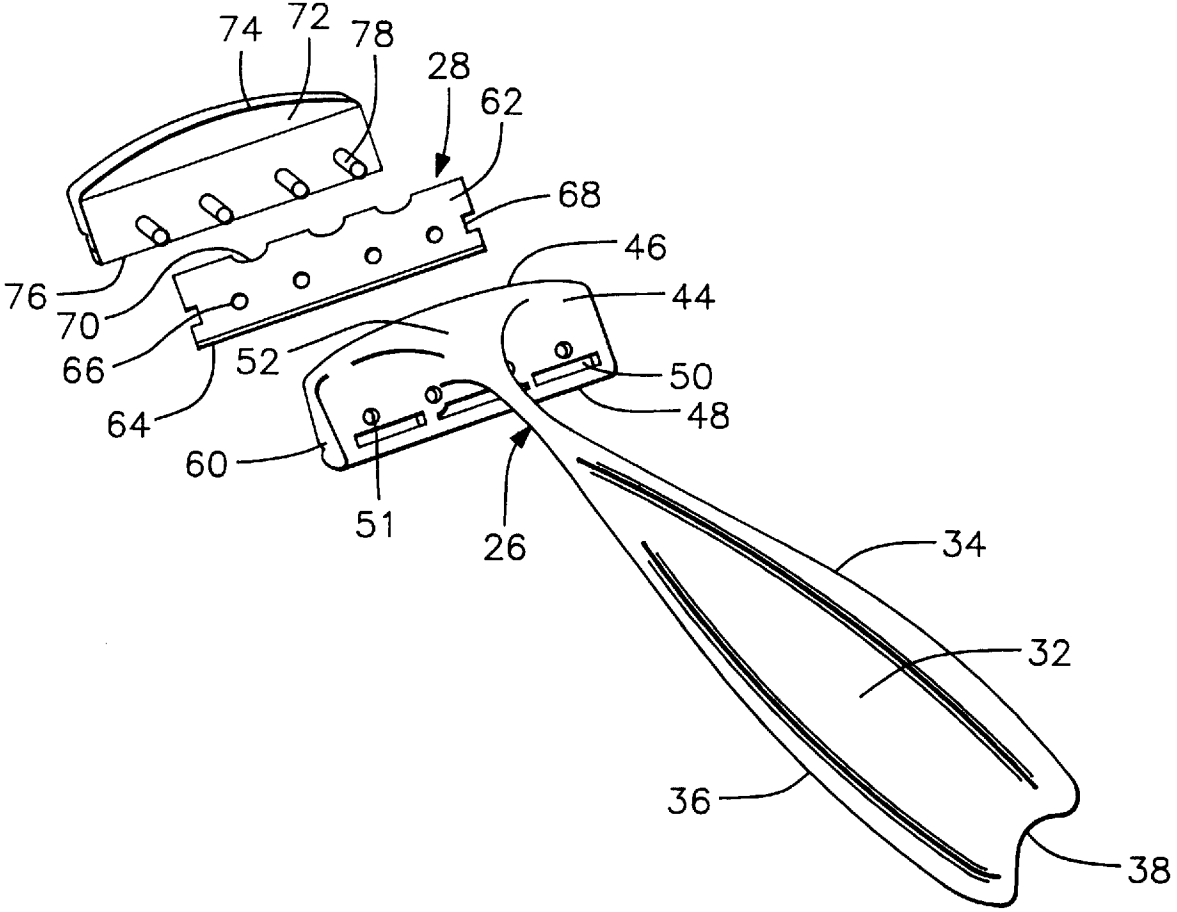
FIG. 8 is an exploded perspective view of the razor illustrating the relationship of the components of the razor head and razor blade.

The razor head 24 includes a razor blade supporting member 44 having a convexly curved upper edge 46 and a straight lower edge 48. Also, the razor blade supporting member 44 is provided with a plurality of slots 50 adjacent to and generally parallel to the edge 48 and a plurality of apertures 51 as illustrated in FIG. 8. The portion of the razor blade support 44 adjacent the convex edge 46 is provided with a mounting portion 52 which has concavely curved side edge portions 54, a concavely curved bottom edge portion 56 and a convexly curved upper portion 58 which merges with the top convex edge 46 of the razor blade supporting member 44. The mounting portion 52 merges with and is of one piece construction with the connecting area 26 and the handle 22 and is made from the same material and which may be made by molding or the like. The opposite surface of the blade supporting member 44 is provided with a notch or recess 60 which positions and supports the razor blade 28.

Figure 4:
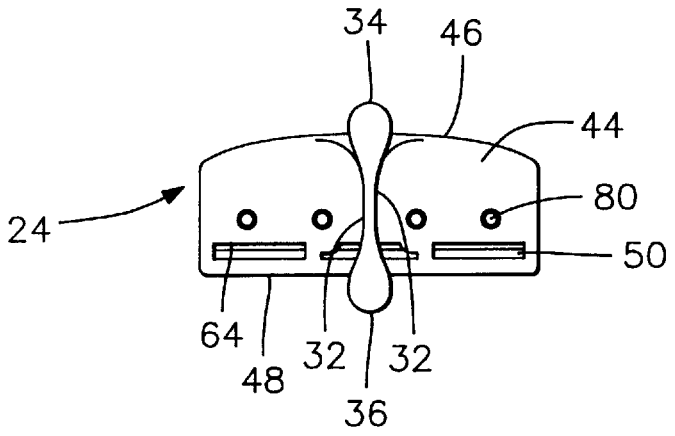
FIG. 4 is an end view from the handle end of the razor.
Figure 5:
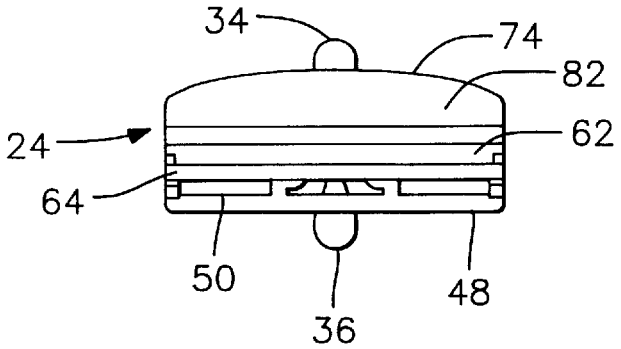
FIG. 5 is an end view from the razor head of the razor.

The razor blade 28 is a rectangular steel blade 62 having a cutting edge 64 and a plurality of spaced apertures 66 which align with the apertures 51 in the blade supporting member 44 of the razor head. The razor blade 28 also includes end notches 68 and notches 70 on the edge opposite from the cutting edge 64. The razor head 24 also includes a razor blade retainer 72 having a convex upper edge 74 and a straight lower edge 76. The surface of the razor blade retainer facing the blade supporting member 44 is provided with a plurality of plastic pins 78 which align with and are inserted through the apertures 66 and apertures 51 after which the pins are heat staked or mushroomed to retain the razor head components in assembled relation as indicated by reference numeral 80 and illustrated in FIG. 4. The outer face of the blade retainer 72 includes a large flat surface area to form a rubbing surface 82 immediately above the razor blade cutting edge 64 which is located above the straight bottom edge 48 which defines a cut guard and immediately above the slots 50 in the blade supporting portion 44 as illustrated in FIG. 5.

Figure 2:
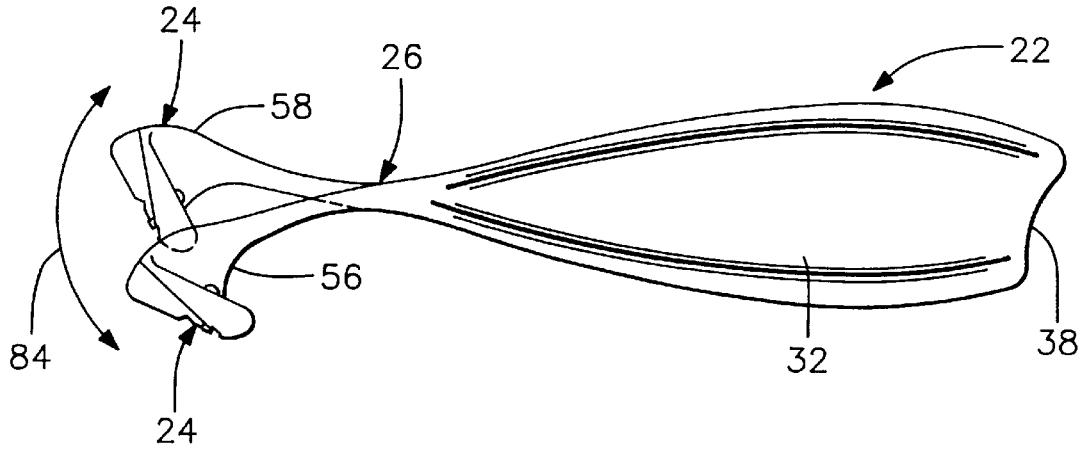
FIG. 2 is a side elevational view of the razor illustrating one capability of movement of the razor head.
Figure 3:
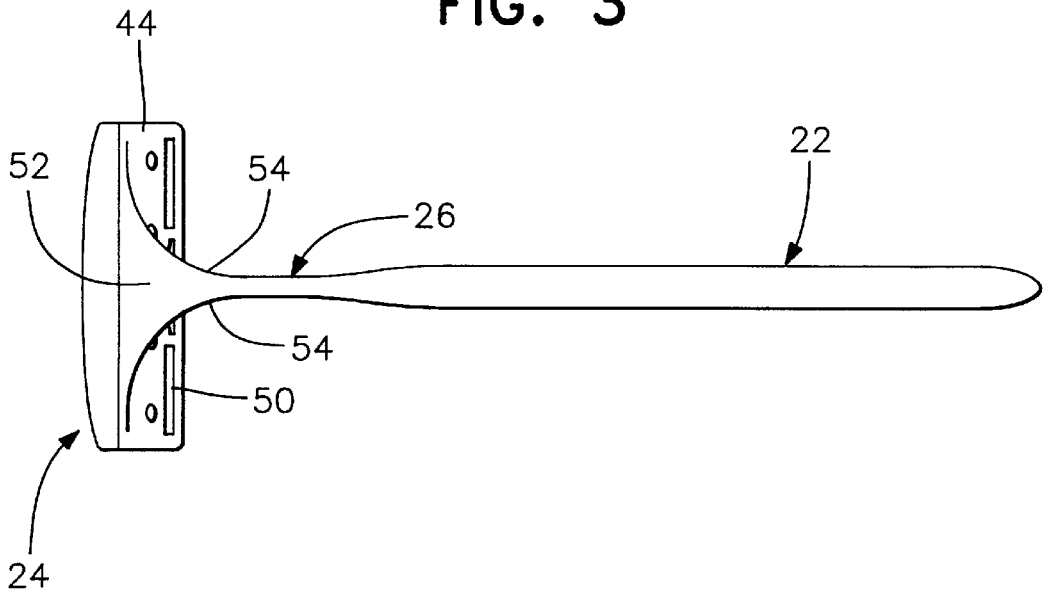
FIG. 3 is top plan view of the razor.
Figure 6:
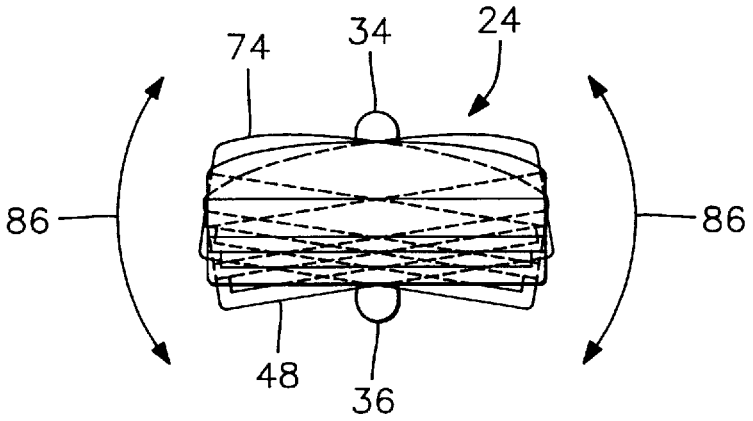
FIG. 6 is an end view from the head end of the razor illustrating another capability of movement of the razor head.
Figure 7:
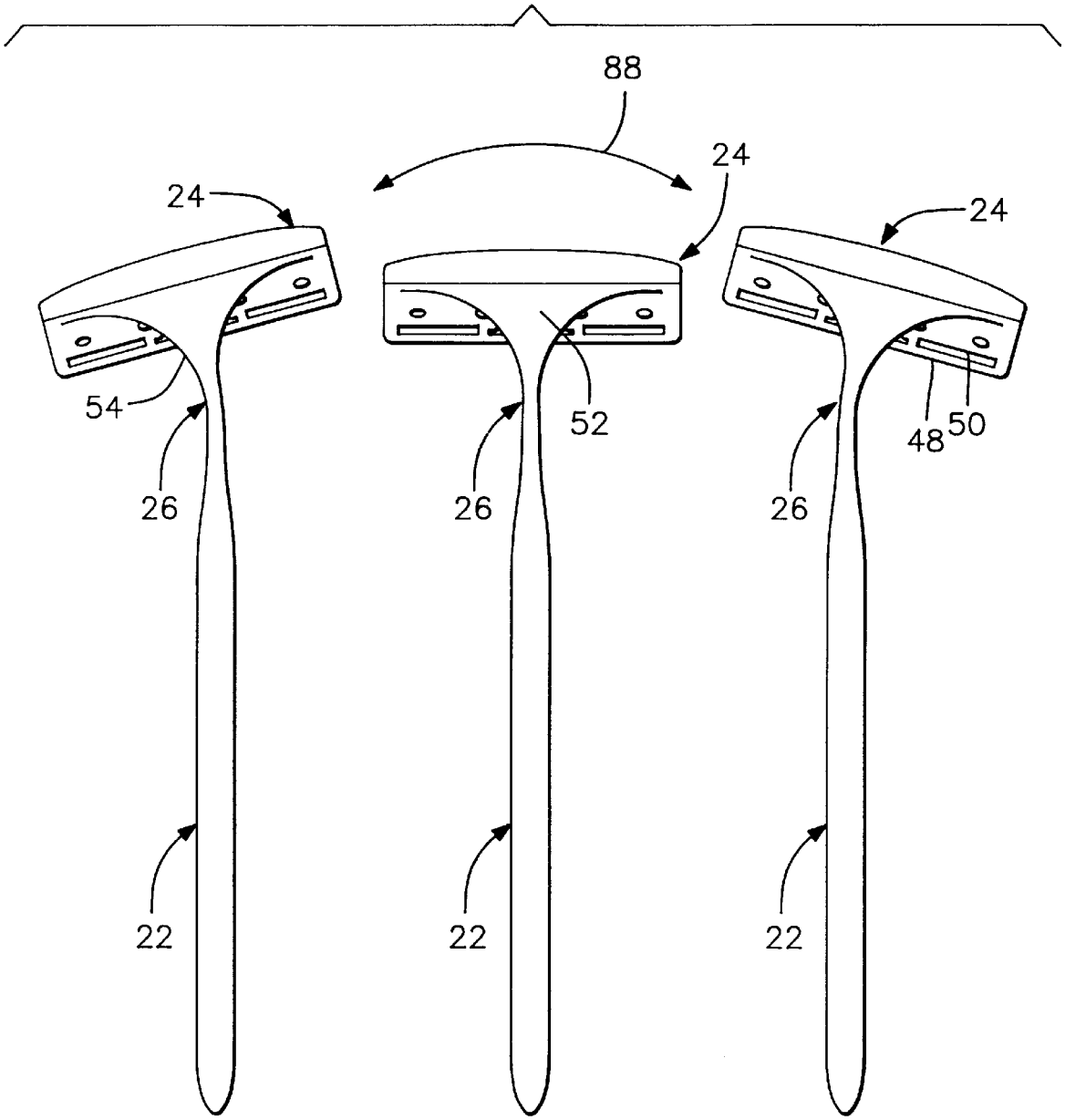
FIG. 7 is a group of top plan views of the razor illustrating another capability of movement of the razor head.

The connecting area 26 is of reduced diameter and is provided with a length approximately four times the diameter. This enables the razor head 24 to move in various directions and planes with respect to the handle 22. As illustrated in FIG. 2, the razor head 24 can move in a vertical arc as indicated by the arrow 84 from a position upwardly moved to a position downwardly moved from a normal position as illustrated in FIG. 1. FIG. 6 illustrates the razor head 24 from the head end and illustrating by the arrows 86 that the razor head 24 can be rotated or twisted in relation to the handle 22 with either of the ends of the razor head moving in a vertical arc. FIG. 7 illustrates another capability of movement where the razor head 24 can flex or bend laterally in either direction relative to the handle as indicated by reference numeral 88.

Figure 10:
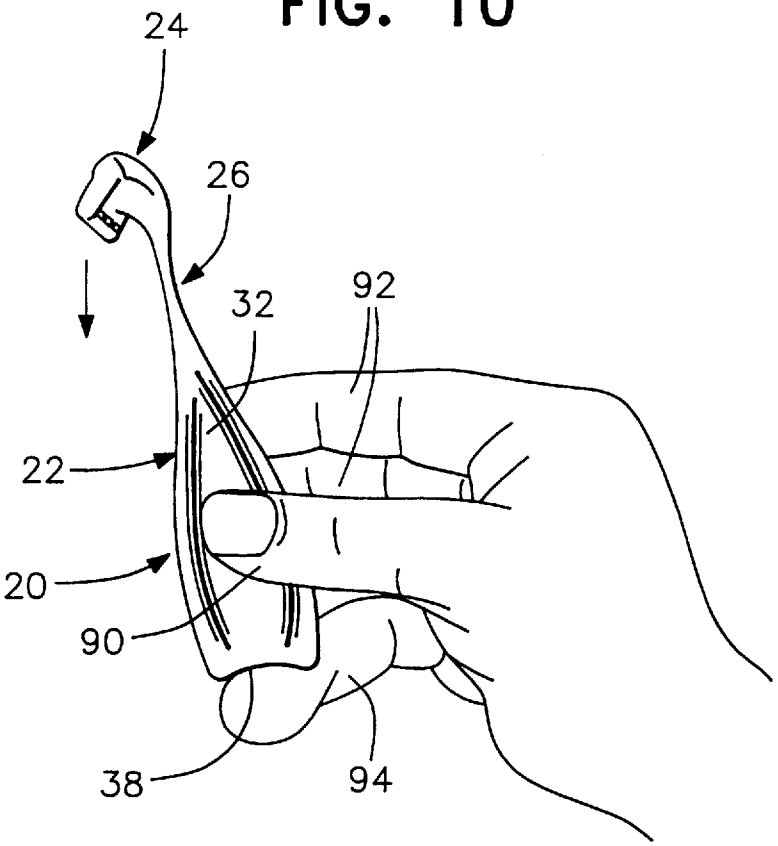
FIG. 10 is a side elevational view of the razor illustrating the razor being used in another vertical orientation.
Figure 11:
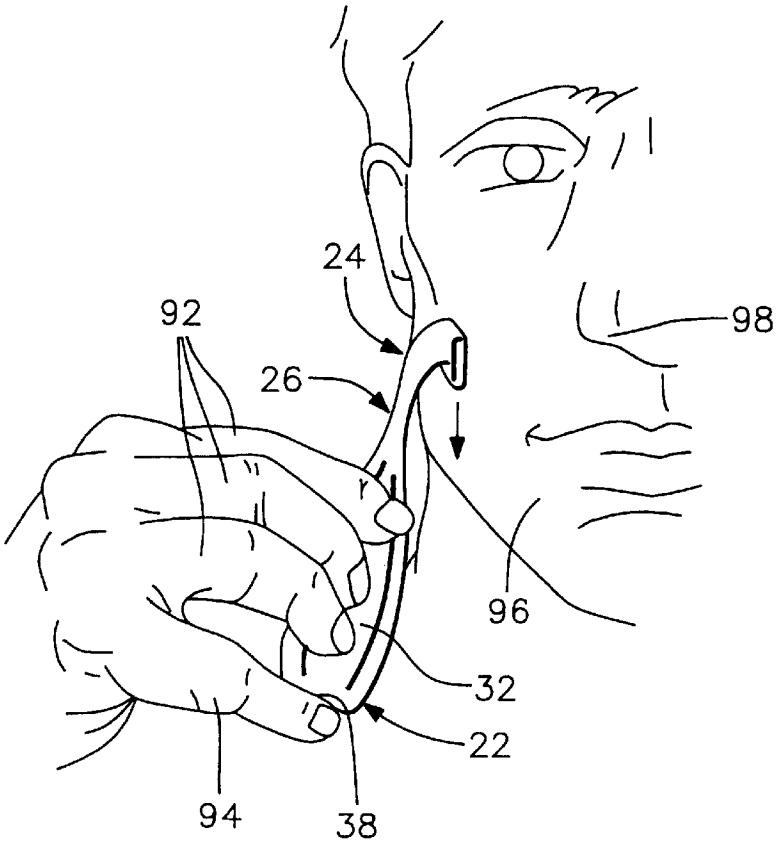
FIG. 11 is a schematic view illustrating the orientation of the gripping hand holding a razor in relation to the skin surface being shaved in one vertical direction of movement of the razor.

FIGS. 9–12 illustrate two arrangements of the razor 20 when being gripped and moved generally in a downward or upward direction although the same gripping arrangement can be used when the razor is oriented in various angular positions. As illustrated in FIGS. 10 and 11, the razor 20 is gripped with the thumb 90 oriented in one concave surface 32 with the thumb generally being perpendicular to the longitudinal axis of the handle 22. All of the fingers 92 except for the fourth finger or little finger 94 are positioned in the concave surface 32 on the opposite side of the handle 22 and generally in opposed relation to the thumb. The fourth finger or little finger 94 is engaged in the concave end edge 38 in generally perpendicular relation thereto to provide effective stabilizing control for the handle 22 which is primarily gripped by the thumb 90 and finger 92. This arrangement enables the razor to be effectively but lightly gripped for vertical movement in relation to the skin surface 96 on the face 98 of the person being shaved. The engagement of the fingers, thumb and little finger in relation to the handle 22 provides an effective but yet light grip for supporting and moving the razor in a downward direction as indicated by the arrows in FIGS. 10 and 11.

Figure 9:
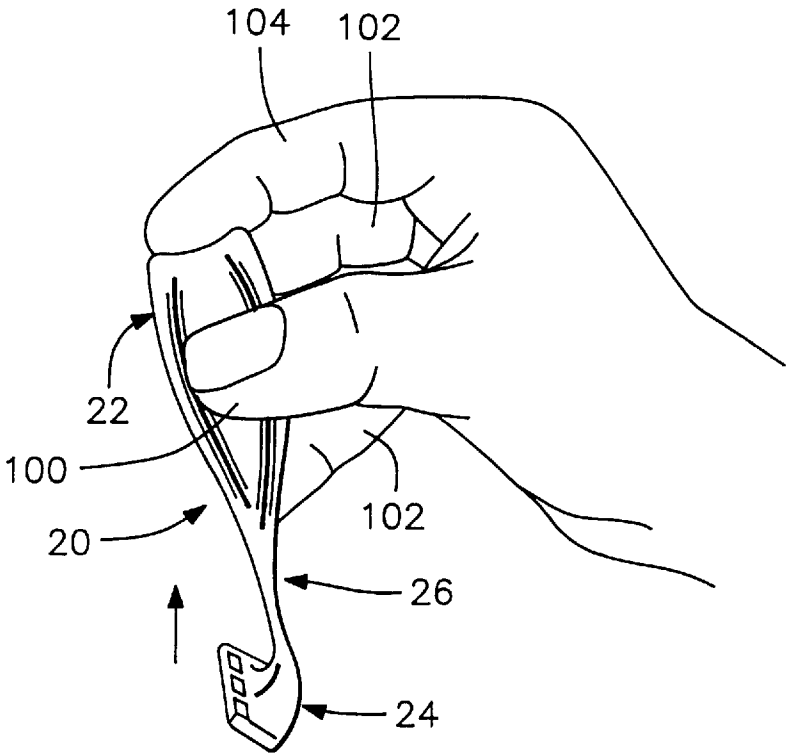
FIG. 9 is a side elevational view of the razor when used in one vertical orientation.
Figure 12:
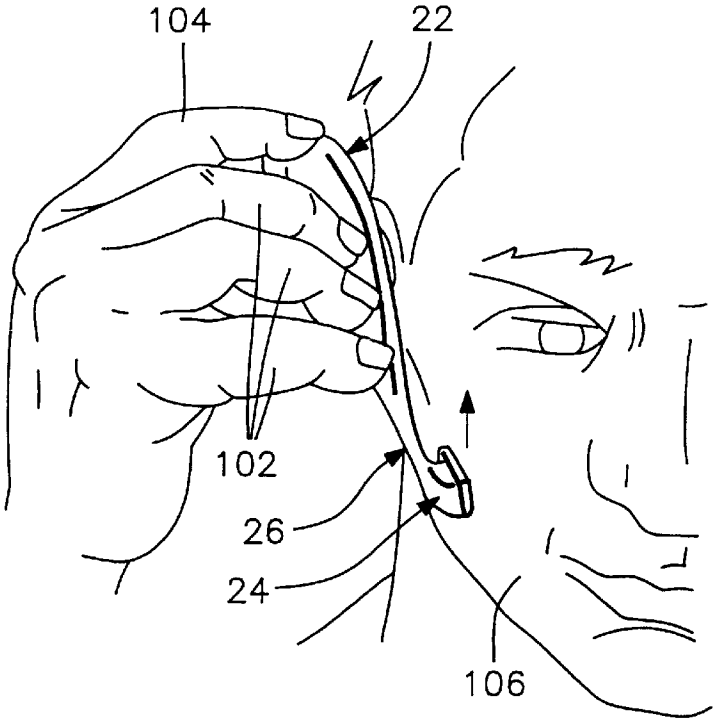
FIG. 12 is a schematic illustration similar to FIG. 11 but illustrating the razor oriented in another vertical orientation.

FIGS. 9 and 12 illustrate a gripping arrangement in which the razor 10 is gripped for movement in an upward direction. In this arrangement, the thumb 100 is placed in one of the concave recesses 32 and the second, third and fourth or little fingers 102 are placed in the concave recess 32 on the opposite surface of the handle 22. The first or index finger 104 is placed in the concave edge 38 with the tip of the finger 104 inserted into the recess with the longitudinal axis of the finger 104 generally paralleling the end edge of the handle 22. In this construction, the razor head 24 can be accurately moved and controlled when moved upwardly in relation to the skin surface 106 being shaved.

The dimensional characteristics of the razor may vary within certain limits. However, one effective embodiment of the invention includes an overall length of about 5 to 5½ inches and preferable 5.115 inches. The vertical height of the handle 22 from the top edge to the bottom edge is preferably 1.031 inches, the overall thickness of the handle 22 is preferably 0.225 inches. The length from side edge to side edge of the razor head is preferably 1.718 inches, the length of the side edges of the razor head is preferably 0.653 inches and the overall thickness of the razor head is preferably 0.215 inches. The connecting area 26 preferably has a length of 0.385 inches and a diameter of 0.096 inches. The preferred material is polypropylene plastic capable of withstanding temperatures normally encountered when shaving with the memory characteristics of the plastic material returning the head to its normal relationship to the handle after it has been flexed or bent in relationship to the handle by engaging the flat rubbing surface 82 with the skin surface 96 or 106 and pressure exerted against the handle with the flexible resilient connection 26 enabling the razor head, razor blade and cutting edge to immediately and accurately orient themselves in proper and optimum relation to the skin surface when the flat rubbing surface of the razor head is contacted with the skin surface and pressure is exerted on the handle to urge the razor head toward the skin surface.

The global or universal movement of the razor head positions the cutting edge of the razor blade in parallel relation to the skin surface to prevent the ends of the cutting edge from digging into the skin surface which can occur when the cutting edge is not positioned parallel to the skin surface. This also positions the cutting edge of the blade at the optimum angle to cut the hair shaft at a 90° angle to the longitudinal axis of the hair shaft and in parallel relation to the skin surface. This enables the cutting edge of the blade to be disposed substantially flush with the skin surface thereby eliminating stubble. Because the hair shaft is stiffer or more rigid at the skin surface, the closer the cutting edge of the blade is to the skin surface and the closer to the skin surface that the hair shaft is cut, the straighter the cut transversely of the hair shaft will be. When the hair shaft is cut any distance from the skin surface where the hair shaft is more flexible increases the probability that the hair shaft will be cut on a bias or on a diagonal rather than perpendicular to the hair shaft which will leave short stubble. Also, by cutting into the hair shaft on a bias and not cutting cleanly through the hair shaft at 90° relation causes the blade cutting edge to grab the hair shaft and attempt to "pull the hair shaft out by the root" which causes pain and requires multiple shaving strokes in an effort to obtain a smooth shave.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A disposable resilient razor comprising a generally longitudinally extending handle, a razor head at one end of said handle and extending transversely thereof, said razor head including a razor blade having a sharpened cutting edge mounted thereon and a flexible, resilient connecting area connecting the razor head to said handle, said handle, connecting area and razor head, except for the razor blade, being constructed of plastic material having memory and resilient characteristics to enable the razor head and the cutting edge of the razor blade mounted thereon to be positioned in substantially flush, parallel relation to the skin surface being shaved in response to force exerted on the handle to move the razor head and razor blade into engagement with the skin surface, said cutting edge of the razor blade engaging a hair shaft closely adjacent the skin surface for cutting the hair shaft in perpendicular relation to the longitudinal axis of the hair shaft, said handle being an elongated member having longitudinally extending concave surfaces on opposite sides, said handle including an upper and lower edge convexly curved longitudinally, said handle including a concavely curved end edge remote from the razor head extending between the top and bottom edges of the razor, said concave side surfaces and end edge enabling the thumb and fingers to engage opposite concave surfaces with the little finger or first finger engaging the concave end edge to enable the razor to be effectively but lightly gripped when supported for vertical upward movement or vertical downward movement.

2. The disposable resilient razor as defined in claim 1 wherein said connecting area has a reduced diameter of plastic material and provided with a length several times greater than the diameter to provide a flexing and bending area with the memory characteristics of the connecting area returning the razor head to a normal position with respect to the handle whenever the razor head is removed from engagement with the skin surface being shaved.

3. The disposable resilient razor as defined in claim 1 wherein said razor head includes a razor blade supporting member and a razor blade retainer, said razor blade and razor blade supporting member including aligned apertures, said razor blade retainer including a plurality of plastic pins aligned with and inserted through the apertures with the ends of the pins being mushroomed to retain the razor blade and razor blade retainer on the blade supporting portion.

4. The disposable resilient razor as defined in claim 3 wherein said razor blade supporting member includes slots in advance of the sharpened edge of the razor blade to discharge cut hair and shaving preparation material removed from the skin surface by said razor blade.

5. The disposable resilient razor as defined in claim 2 wherein said razor head includes a razor blade supporting member and a razor blade retainer, said razor blade and razor blade supporting member including aligned apertures, said razor blade retainer including a plurality of plastic pins aligned with and inserted through the apertures with the ends of the pins being mushroomed to retain the razor blade and razor blade retainer on the blade supporting portion.

6. The disposable resilient razor as defined in claim 1 wherein said razor head includes a large flat area adjacent the sharpened edge of the razor blade to form a rub surface to engage the skin surface to cause the razor blade cutting edge to move to parallel relation to the skin surface when force is exerted on the handle to move the razor head against the skin surface and to cut hair shafts closely adjacent the skin surface.

7. A razor comprising an elongate handle, a razor head with a razor blade having a cutting edge mounted transversely of said handle at an end thereof, and a resilient, flexible connection between the handle and razor head, said razor head including a flat surface area extending transversely of and remote from the handle for engagement with a skin surface area to be shaved, said resilient, flexible connection enabling the flat surface area to move to a position in flush surface to surface engagement with the skin surface, said cutting edge of the razor blade being exposed through the flat surface area to engage the skin surface area, said flat surface area on the razor head and said resilient, flexible connection enabling the cutting edge to self adjust to parallel relation to the skin surface when force is exerted on the handle to move the razor head toward the skin surface thereby eliminating nicks and cuts caused by the ends of the blade digging into the skin surface being shaved, said flat surface area and resilient, flexible connection positioning the cutting edge of the blade in substantially flush relationship to said skin surface and in a position to cut whisker hair shafts in 90° relation to the longitudinal axis of the hair shaft closely adjacent the skin surface area where the hair shafts are stiffer thereby reducing residual stubble and resulting in a smooth shave without pain resulting from exerting an outward pulling force on the hair shafts which occurs when hair shafts are cut diagonally of the longitudinal axis of the hair shafts, said handle being an elongated member having longitudinally extending concave surfaces on opposite sides, said handle including an upper and lower edge convexly curved longitudinally, said handle including a concavely curved end edge remote from the razor head extending between the top and bottom edges of the razor, said concave side surfaces and end edge enabling the thumb and fingers to engage opposite concave surfaces with the little finger or first finger engaging the concave end edge to enable the razor to be effectively but lightly gripped when supported for vertical upward movement or vertical downward movement.

8. The razor as defined in claim 7 wherein said resilient, flexible connection includes a resilient, flexible area interposed between the handle and razor head to enable the razor head to resiliently move in any direction and plane in relation to the handle.

9. The razor as defined in claim 8 wherein said resilient, flexible area includes an area of reduced cross sectional area of plastic material of unitary construction with said handle and a portion of the razor head, said area of plastic material being resiliently bendable and having memory characteristics to return the razor head to original relation to the handle when the razor head is disengaged from the skin area.

10. The razor as defined in claim 7 wherein said razor head includes a razor blade supporting member and a razor blade retainer, said razor blade and razor blade supporting member including aligned apertures, said razor blade retainer including a plurality of plastic pins aligned with and inserted through the apertures with the ends of the pins being mushroomed to retain the razor blade and razor blade retainer on the blade supporting portion.

11. The razor as defined in claim 10 wherein said razor blade supporting member includes slots in advance of the sharpened edge of the razor blade to discharge cut hair and shaving preparation material removed from the skin surface by said razor blade, said razor head includes a razor blade supporting member and a razor blade retainer, said razor blade and razor blade supporting member including aligned apertures, said razor blade retainer including a plurality of plastic pins aligned with and inserted through the apertures with the ends of the pins being mushroomed to retain the razor blade and razor blade retainer on the blade supporting portion.

* * * * *